United States Patent [19]

Norton

[11] 4,352,669

[45] Oct. 5, 1982

[54] PROCESS AND APPARATUS FOR MANUFACTURING PLASTIC CONTAINERS

[75] Inventor: William W. Norton, Lincolnshire, Ill.

[73] Assignee: Baxter Travenol Laboratories, Inc., Deerfield, Ill.

[21] Appl. No.: 205,789

[22] Filed: Nov. 10, 1980

[51] Int. Cl.[3] ..... B31B 1/84

[52] U.S. Cl. ..... 493/213; 493/195

[58] Field of Search ..... 493/213, 212, 929, 193–196; 128/214 D; 53/553, 555

[56] References Cited

U.S. PATENT DOCUMENTS

| | | | |
|---|---|---|---|
| 3,069,303 | 12/1962 | Scholle | 493/213 X |
| 3,283,671 | 11/1966 | Campbell, Jr. | 493/213 X |
| 3,868,891 | 3/1975 | Parish | 493/213 X |
| 4,027,577 | 6/1977 | Thompson et al. | 493/212 |
| 4,166,412 | 9/1979 | Versteege | 493/213 X |
| 4,313,904 | 2/1982 | Larkin et al. | 264/515 |

*Primary Examiner*—James F. Coan

*Attorney, Agent, or Firm*—Paul C. Flattery; John A. Caruso; George H. Gerstman

[57] ABSTRACT

An automated system is provided for manufacturing flexible plastic blood containers (10) having closed ports (22, 24) and a donor tube (26) extending from one end (20) of the containers. First (12*a*) and second (12*b*) webs of plastic material are conveyed to a port sealing station. Mandrels (71–85) are provided intermediate the first and second webs at the port sealing station. The mandrels are moved forwardly through both webs so that the front ends of the mandrels extend past opposed ends of the webs to engage the closed ports and donor tubes. The mandrels are retracted to bring the closed ports and donor tubes intermediate the opposed ends of the webs, and the opposed ends are heat sealed to each other. The mandrels are retracted further to disengage from the closed ports and donor tubes. The webs are conveyed to sealing and cutting stations (64, 66) to seal the sides and other end of the webs and to cut the webs transverse their direction of conveyance.

27 Claims, 7 Drawing Figures

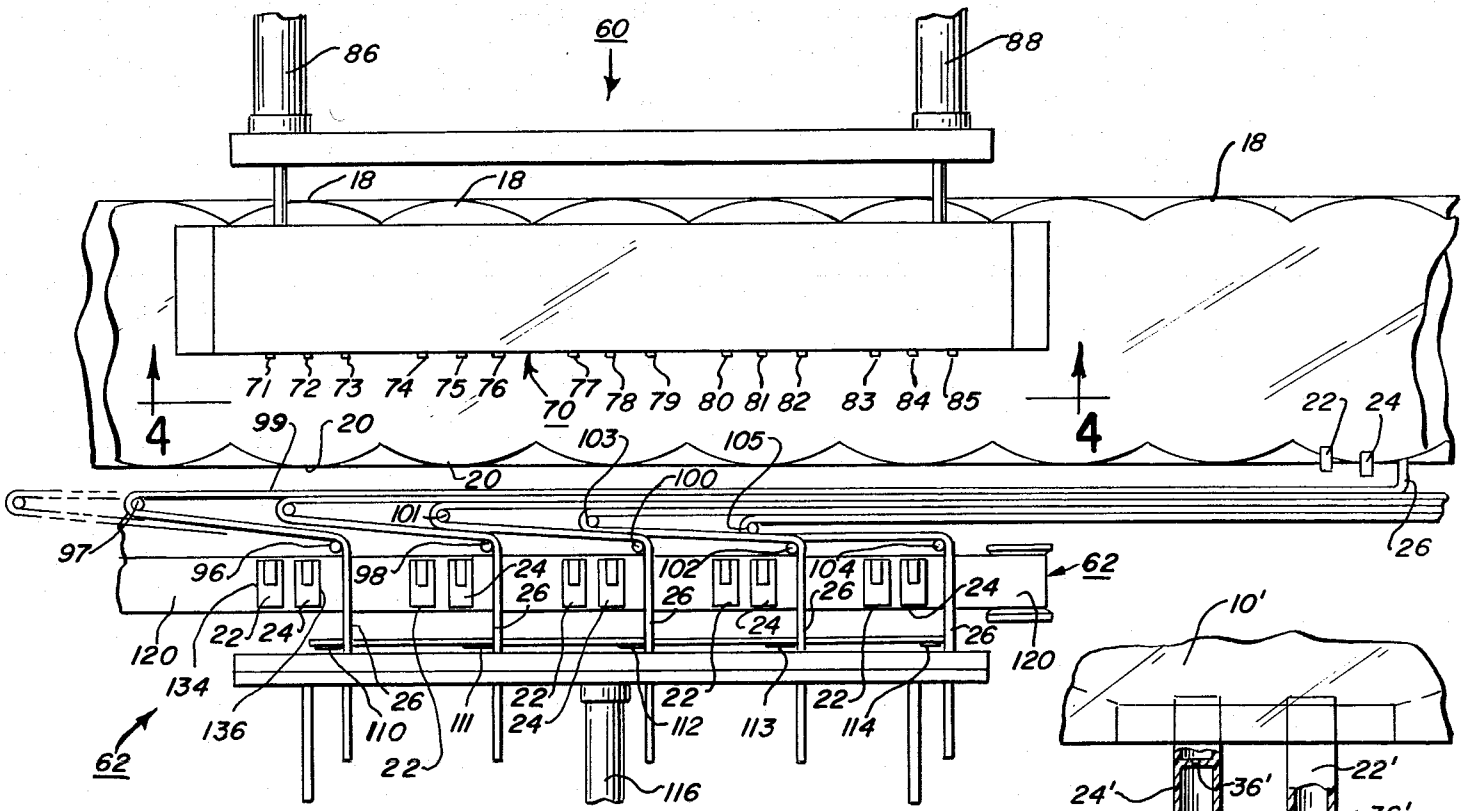
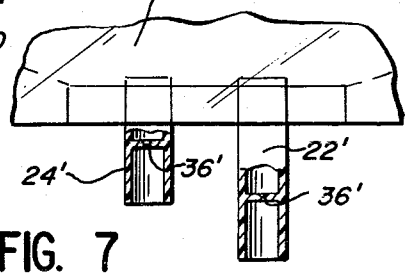
FIG. 7

PROCESS AND APPARATUS FOR MANUFACTURING PLASTIC CONTAINERS

TECHNICAL FIELD

The present invention concerns a process and an apparatus for manufacturing plastic containers having ports extending from one end of the plastic containers. The present invention is particularly suitable for use in the manufacturing of flexible plastic containers for medical use, such as flexible plastic blood containers.

BACKGROUND ART

Flexible plastic medical containers are often used in the medical field, for example to contain and receive various sterile solutions, dialysis solution, whole blood, plasma, etc. An example of a well-known flexible plastic medical container is the Viaflex® flexible vinyl container, sold by Baxter Travenol Laboratories, Inc.

In manufacturing the flexible plastic containers, webs of sheet material are cut and heat sealed, with the ports being interposed at one end of the container and the webs being heat sealed around the ports. One prior art method and apparatus for producing flexible plastic medical containers is disclosed in British Pat. No. 1,553,244.

There is a significant problem in providing automated machinery for manufacturing flexible plastic containers in which the port is a closed port. A "closed port" is a port in which the port is not open from one end to the other. For example, a port having a transverse pierceable membrane therein would be considered a "closed port", as would a port that is covered with a tab or the like to close one end thereof. Flexible plastic containers which are used for containing, collecting and/or storing blood or blood plasma typically utilize a pair of closed ports at one end thereof, with each of the closed ports comprising a port having a transverse pierceable membrane and a pair of tabs sealed over the distal end of the port to prevent access to the port until the tabs are pulled away from each other.

The significant problem in providing automated machinery for such flexible plastic bags with closed ports results from the fact that a mandrel located at one side of the container cannot readily be utilized to insert the closed port into one end of the container whereupon heat sealing will occur. Since a closed port inherently contains some blockage, a mandrel which is intended to enter the container from the outside cannot place the closed port in position for heat sealing and also allow the sealing to occur over the mandrel. Thus it has been found necessary for the production of flexible plastic bags having closed ports to require a significant number of manual steps, in order for the mandrel to cooperate with both the web material for the container and the closed ports during heat sealing.

Flexible plastic blood containers may also include a donor tube, which comprises an elongated tube having a code designation imprinted repeatedly along the tube. When blood is collected in the container, the blood which is contained within the donor tube may be removed for testing by sealing off portions of the donor tube. The code number will be used to identify the particular sample as being from a particular donor.

In automating the manufacture of flexible plastic blood containers, it is most efficient if the cutting and connecting of the donor tube to one end of the container can be part of the automatic process, together with the connecting of the closed ports to that end of the blood container. It is particularly important, however, that the cutting of the donor tube be accurate, because it is mandatory that all of the code numbers along the donor tube be identical to each other and that the donor tube have a precise, predetermined length.

DISCLOSURE OF THE INVENTION

It is an object of the present invention to provide an automated system for manufacturing plastic containers having closed ports extending from one end thereof.

Another object of the present invention is to provide an automated system for manufacturing plastic containers in which closed ports may be heat sealed to one end of the container, without requiring any manual handling of the webs of plastic material during processing.

A further object of the present invention is to avoid manual contamination problems by utilizing an automated system for manufacturing flexible plastic blood containers having closed ports and a donor tube extending from one end of the container.

A still further object of the present invention is to provide an automated system for manufacturing a flexible plastic blood container having a donor tube that is properly cut and connected to one end of the flexible plastic blood container.

Another object of the present invention is to provide an automated system for manufacturing flexible blood containers, which system is relatively simple in construction yet efficient in operation.

Other objects and advantages of the present invention will become apparent as the description proceeds.

In accordance with the present invention, a method is provided for manufacturing plastic containers having closed ports extending from one end of the plastic containers. The method comprises the steps of providing a first web of plastic material, providing a second web of plastic material, conveying the first and second webs to a port sealing station and conveying a closed port to a position adjacent the port sealing station. A mandrel is provided intermediate the first and second webs at the port sealing station. The mandrel is moved relatively with respect to the closed port to engage the closed port with the mandrel. The mandrel is retracted away from the closed port position to bring the closed port toward the webs and then intermediate opposed ends of the first and second webs. The opposed ends of the first and second webs are sealed while the closed port is intermediate the opposed ends. The mandrel is retracted to disengage from the closed port and the other end of the webs is sealed. The webs are cut transverse their direction of conveyance.

In the illustrative embodiment, the steps of providing the first and second webs comprise the providing of a double ply roll of flexible plastic material. The ends of the webs are cut to a predetermined shape in the direction of conveyance upstream of the port sealing station, and the webs are split apart from each other downstream of the cutting to a predetermined shape but upstream of the port sealing station.

In the illustrative embodiment, the step of moving the mandrel relatively with respect to the closed port comprises moving the mandrel forwardly through both webs so that a front end of the mandrel extends past the opposed ends of the webs to engage the closed port, with the mandrel being received inside the closed port with sufficient frictional engagement to enable the closed port to move with the mandrel when the mandrel is retracted.

In the illustrative embodiment, the step of sealing the sides and other end of the webs occurs downstream of the port sealing station and the step of cutting the webs transverse their direction of conveyance occurs downstream of sealing of the sides and other end of the webs.

In the illustrative embodiment, a plurality of closed ports are conveyed to the port sealing station and a plurality of mandrels are simultaneously provided, moved and retracted to manufacture a plastic container having a plurality of closed ports extending from one end thereof. An elongated tube is provided having an end thereof next to the closed ports adjacent the port sealing station. Another mandrel is provided to operate simultaneously with the closed port mandrels, to engage the elongated tube's end and to bring it toward the webs and then intermediate opposed ends of the webs. In this manner, the resulting container will have closed ports and an elongated tube extending from one end thereof.

The apparatus of the present invention includes means for conveying first and second webs of plastic material to a port sealing station. The port sealing station includes a mandrel and means for moving the mandrel in forward and retracted positions transverse the conveying means. Means are provided for conveying closed ports to a position adjacent the port sealing station. The web conveying means includes means for conveying the first web over the mandrel and means for conveying the second web under the mandrel. The mandrel moving means are operative to move the mandrel to engage a closed port with the mandrel and to bring the closed port intermediate opposed ends of the first and second webs. Sealing means are provided at the port sealing station for sealing the opposed ends while the closed port is intermediate the opposed ends. Means are provided for conveying the webs with the sealed opposed ends away from the port sealing station. Means are provided for sealing the sides and other end of the webs and means are provided for cutting the webs transverse the conveying means.

A more detailed explanation of the invention is provided in the following description and claims, and is illustrated in the accompanying drawings.

BRIEF DESCRIPTION OF THE DRAWINGS

FIG. 3 is a plan view of a portion of the port sealing station of the system of FIG. 2.

FIG. 7 is a fragmentary enlarged view of certain types of ports connected to an end of a flexible plastic container, with portions broken away for clarity.

DETAILED DESCRIPTION OF THE ILLUSTRATIVE EMBODIMENT

Figure 1:
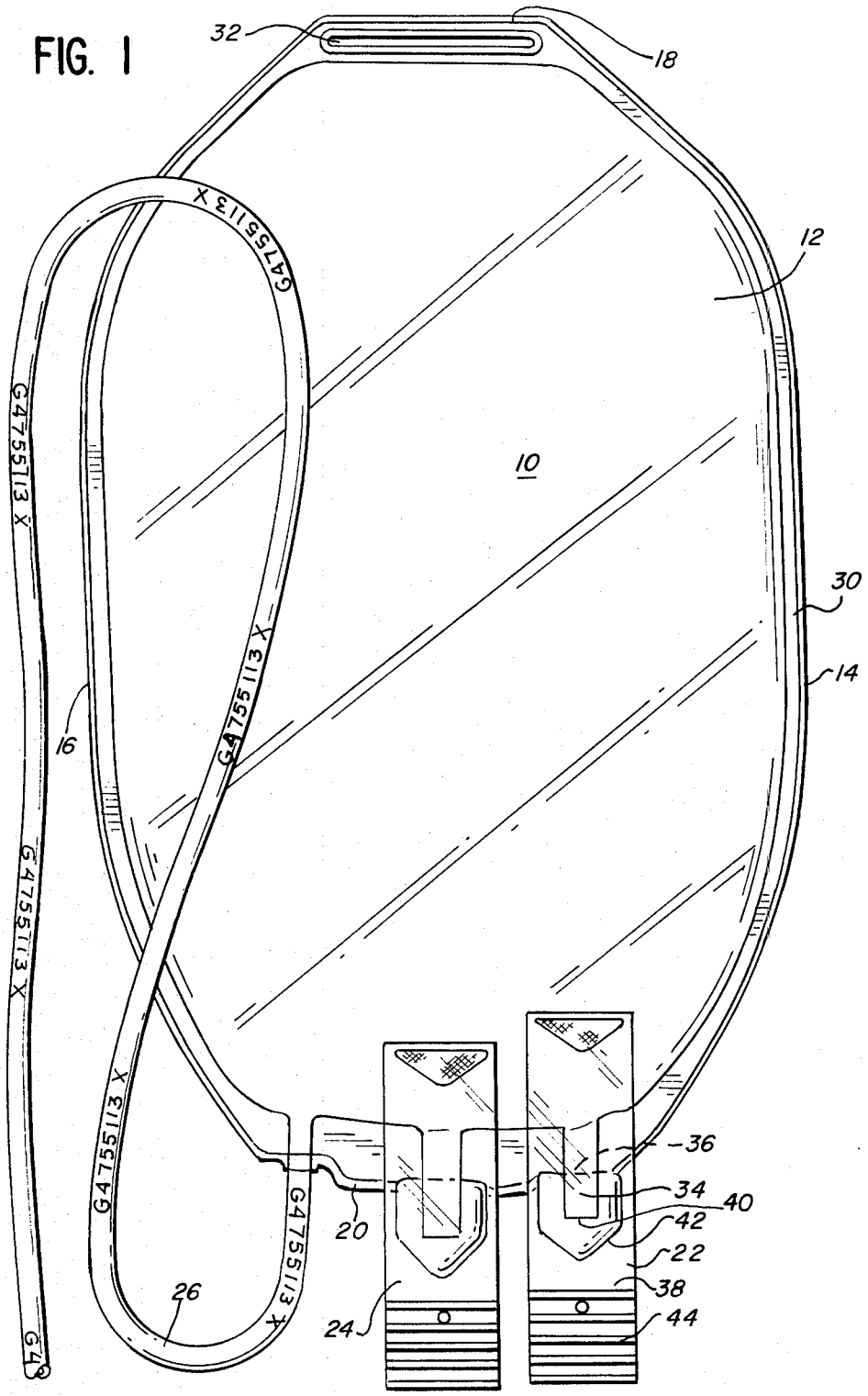
FIG. 1 is a view of a flexible plastic blood container constructed in accordance with the automated system of the present invention.

In FIG. 1 there is shown a flexible vinyl blood container constructed using the system of the present invention. The blood container 10 comprises a main container portion 12 having sides 14, 16 and ends 18, 20. Two closed ports 22 and 24 are connected at end 20 of container 10 and a donor tube 26 is also connected at end 20. It can be seen that donor tube 26 carries a repeated donor code along its length.

Container 10 has a heat seal 30 around its periphery with a hanger slot 32 defined by the heat seal at end 18.

Ports 22 and 24 are substantially identical and therefore only port 22 will be described in detail. This port includes a relatively rigid vinyl tube 34 having a transverse pierceable membrane 36, as is well-known in the blood container art. Also as is well-known in the art, overlying and underlying the tube 34 are a pair of tab members 38 which are heat sealed around the end 40 of tube 34 by means of a heat seal 42. Each of the tab members 38 has serrations 44 at its distal end. In order to obtain access to tube 34, the operator must grasp the serrated portions 44 of the tabs 38 and pull the tabs apart so as to open heat seal 42 to expose end 40 of tube 34. Communication to the inside of container 10 is provided by inserting a hollow spike through membrane 36 as is well-known in the art.

The present invention provides an automated system for producing container 10 and enabling closed ports (the manufacture of which does not form a part of this invention) such as closed ports 22,24 plus a donor tube 26 to be heat sealed at an end of the flexible plastic container.

Figure 2:
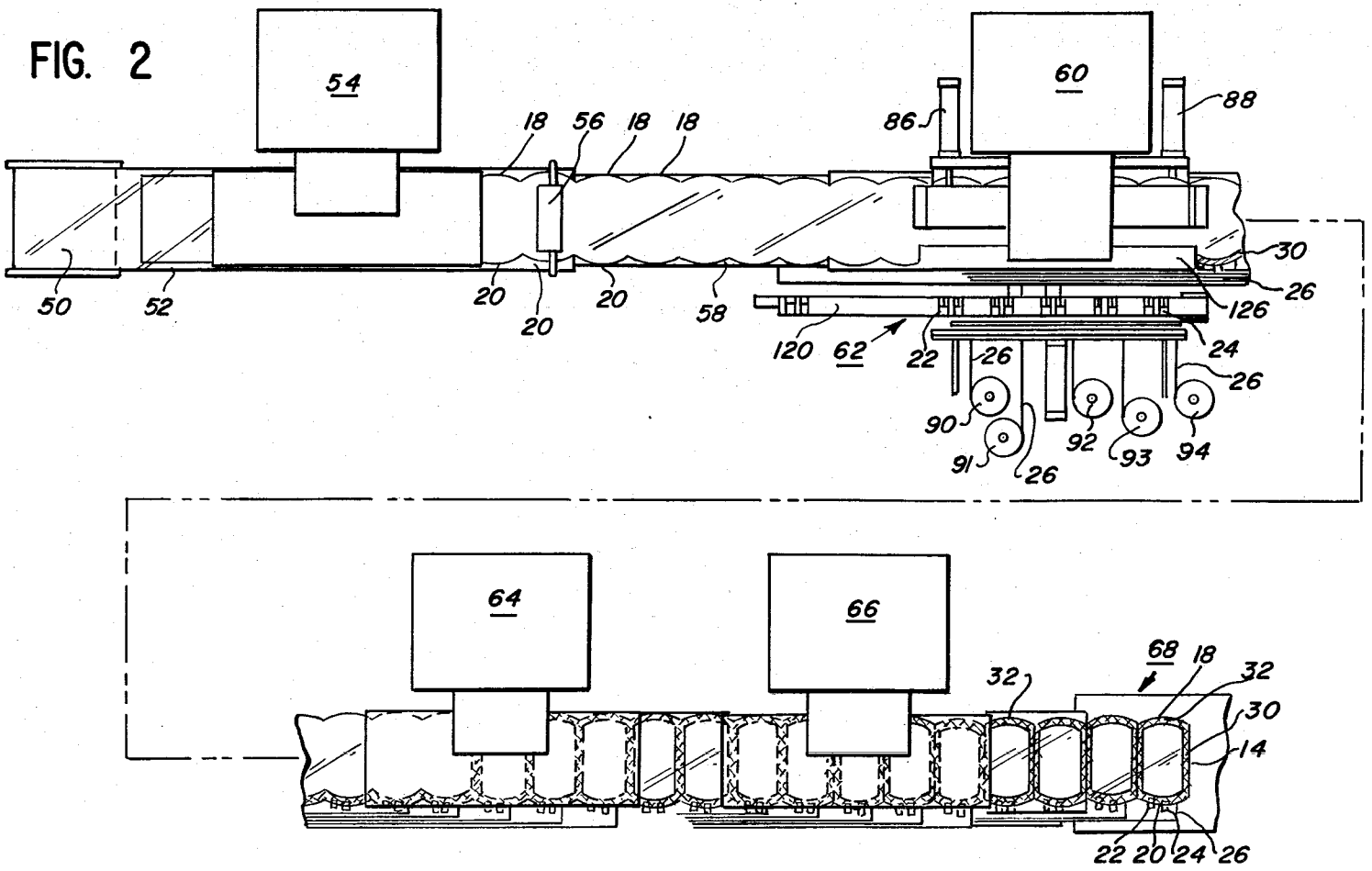
FIG. 2 is a plan view, in diagrammatic form, of an automated system for manufacturing flexible plastic containers, in accordance with the principles of the present invention.

A diagram showing the basic operation of the system is illustrated in FIG. 2. Referring to FIG. 2, a roll 50 comprising a two ply roll of vinyl sheet material is located adjacent a conveyor belt 52. Both plies of vinyl sheet material are fed from roll 50 by means of conveyor belt 52 (in the rightward direction with respect to FIG. 2) to a front and back cutting station 54. At station 54 both webs are cut to form shaped ends 18 and 20, the arcuately cut webs are then fed to a splitter 56 which splits the first web from the second web and the split is maintained by a web support table 58. Both webs are conveyed to a port sealing station 60 which has a port conveyor 62 located adjacent thereto. Conveyor 62 is shown in more detail in FIG. 6 which will be discussed below.

In the illustrative embodiment, port sealing station 60 handles five containers simultaneously. Thus 10 closed ports (2 per container) and five donor tubes (1 per container) are inserted into and heat sealed to the web pair forming five containers, simultaneously.

Continuing the reference to FIG. 2, once the closed ports and donor tubes are connected to the webs simultaneously to form five containers, the webs to form the five containers are conveyed to a side and back sealing station 64. At station 64 a heat seal is provided along sides 14 and 16 and back end 18, and then the containers are conveyed to a side and slot cutting station 66. At station 66 cuts are made transverse to the conveying direction to separate the container units from each other and hanger slot 32 is formed. The containers are then conveyed to a parting and stacking station 68.

Figure 5:
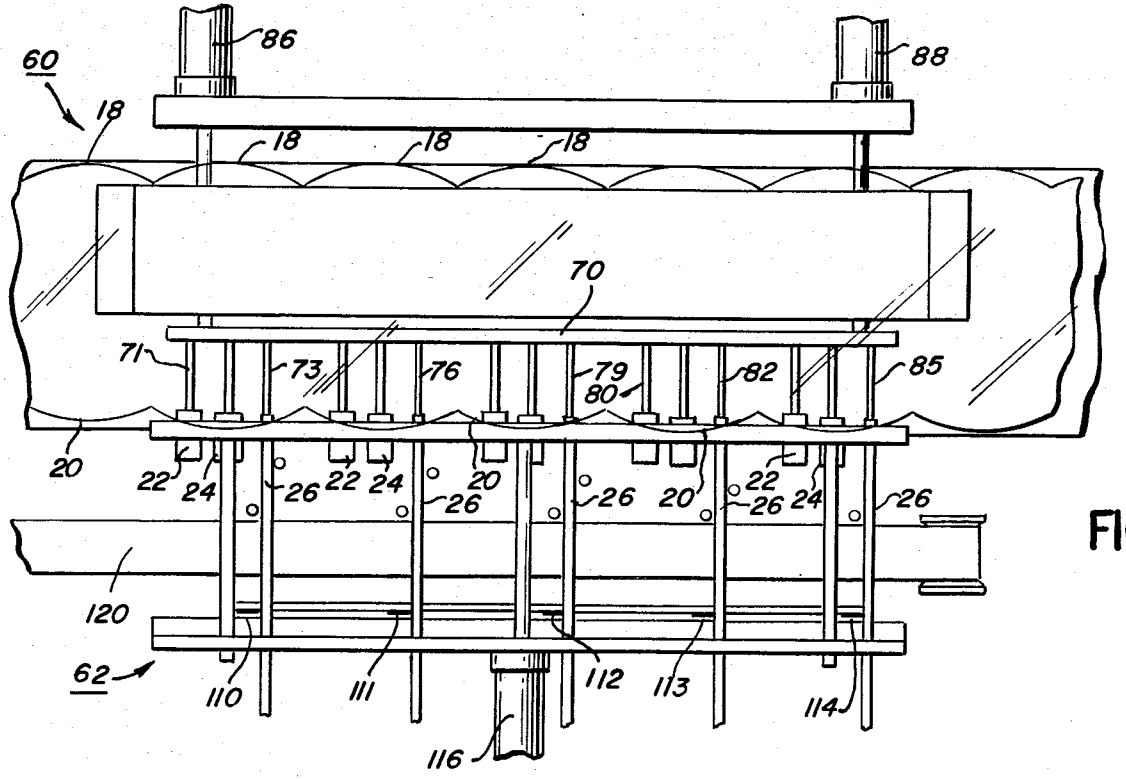
FIG. 5 is an enlarged plan view of the port sealing station of FIGS. 2 and 3, showing the mandrels in their extended positions.
Figure 4:
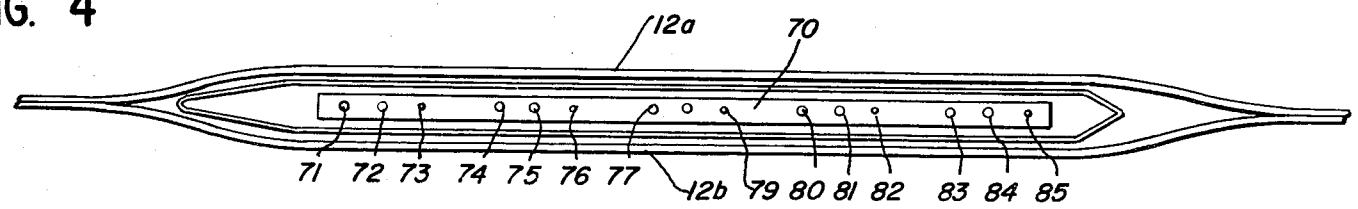
FIG. 4 is an end view of a mandrel header, taken along the plane of the line 4—4 of FIG. 3.

The operation at the port sealing station can be more readily understood by referring to FIGS. 3–5. At port sealing station 60 there is a mandrel header 70 which includes 15 mandrels 71–85. The mandrels are moved to an extended position and retracted positions by means of hydraulic cylinders 86, 88. As illustrated in FIG. 4, mandrel header 70 is interposed between the top web 12*a* and the bottom web 12*b*. In FIG. 3 it can be seen that mandrels 71 and 72 are aligned with closed ports 22 and 24. Likewise, mandrels 74 and 75 are aligned with the next pair of closed ports 22 and 24, and likewise with mandrels 76 and 77, 78 and 79, 80 and 81 and 83, 84 and 85. Donor tubes 26 extend from donor tube rolls 90–94 (FIG. 2) and are directed around indexing rollers 96–105 (FIG. 3). Five cutting knives 110–114 (FIG. 3) are provided adjacent each of the donor tubes 26. When the downstream containers have been conveyed to a predetermined point, donor tubes 26 will be cut by knives 110–114 and then hydraulic cylinder 116 will operate to move the donor tubes (which are coupled to manifold 118) forwardly so that the ends of the donor tubes lay upon belt 120 of conveyor 62, alongside closed ports 22 and 24.

As an alternative arrangement, elongated donor tubes 26 could have score lines cut in advance at the point where breakage is desired. As the downstream containers are conveyed, the tension on the donor tubes by means of the indexing rollers 97–104 will cause the donor tubes to break at the score lines. It is very important that the donor tubes become separated at the proper place, so that each donor tube will not contain the donor code from another donor tube. For example, the donor tube may be three feet in length and contain 10 repetitions of a single donor code. Each 3-foot length must contain a different donor code and thus the score line would be provided along the donor tubing between two different donor codes.

Once the closed ports 22, 24 and the cut donor tube 26 is in place on belt 120 and in alignment with the respective mandrels, hydraulic cylinders 86 and 88 are actuated to extend the mandrels into the open ends of the closed ports and donor tubes. The mandrels are sized so that they will fit relatively snugly into the closed ports and donor tubes with a frictional fit, and once inserted, hydraulic cylinders 86 and 88 are operated to retract the mandrels so that closed ports 22 and 24 and donor tubes 26 are positioned between upper ply 12*a* and lower ply 12*b*, as illustrated in FIG. 5. Once the mandrels are in the FIG. 5 position, an rf heat die 126 (FIG. 2) is operated to heat seal the opposed ends 20 of the webs to each other and over and under the closed ports and donor tubing. At the time of heat sealing the mandrels will remain in place within the port and tubing opening, so that the ports and tubing will not be sealed closed. After this heat sealing has occurred, hydraulic cylinders 86 and 88 are actuated to retract the mandrels further back and the five containers with the ends 20 heat sealed, are conveyed to the side and back end sealing station 64. The sides and back end heat seal is provided to close the container completely and as the sealed container is conveyed to the side and slot cutting station 66, the donor tubes 26 are cut (or automatically severed by tension if the scoring line is provided).

An alternative to using a mandrel header 70 with hydraulic cylinder action is the use of the endless recirculating chain or belt in which the mandrels extend radially outwardly and are rotated with the chain or belt. Within the recirculating chain or belt is a mechanism for extending and retracting the mandrels. This mechanism may take the form of a camming device, a solenoid device or the like.

Using the recirculating chain or belt, as with the illustrative embodiment, the mandrels can engage the closed ports 22 and 24 when extended and then bring the closed ports to a position between the webs when slightly retracted. Further retraction of the mandrels will bring the mandrels behind the heat seal area so that the webs can pass and a new set of mandrels can be rotated into place.

By using the recirculating chain mandrel drive, instead of fully retracting mandrels immediately after heat sealing and having the webs pass over and under the mandrels, the webs and mandrels may move together for a short distance after heat sealing. Thereafter, the mandrels are further retracted back to bring the mandrels away from the heat seal area and to allow the webs to pass over and under the mandrels.

Figure 6:
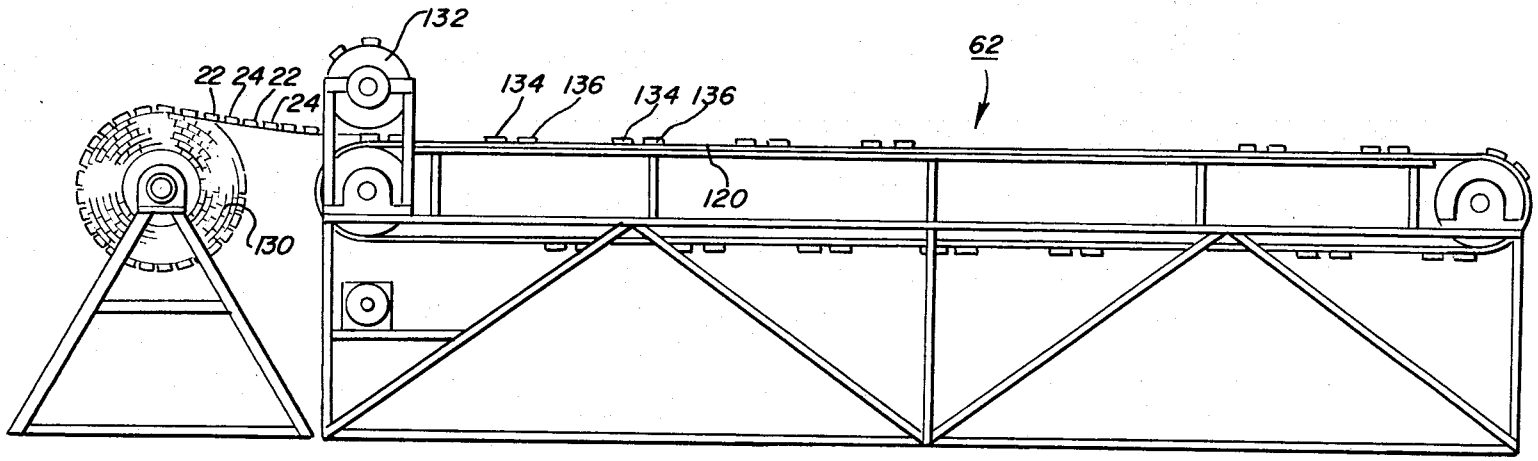
FIG. 6 is a side elevation of the port conveyor of the FIG. 2 system.

Conveyor belt 120 may be provided with closed port nests 134, 136 to prevent closed ends 24 and donor tube 26 from being forced rearwardly by the mandrels as they enter the openings thereof. The closed port conveyor 62 is illustrated in FIG. 6, in which a stock closed port roll 130 is illustrated feeding the roll of closed ports 22, 24 to a feeder sprocket 34 which operates to sever the closed ports 22, 24. Endless conveyor belt 120 carries a number of spaced pairs of nests 134, 136 into which closed ports 22, 24, respectively, are indexed as they are separated by means of feeder sprocket 132. Thus feeder sprocket 132 contains a sprocket which engages each of the closed ports, causes it to separate from the adjacent closed port and also forces it into one of the nests 134 or 136. Movement of conveyor 120 is synchronized with movement of roll 120 so that the closed ports will be indexed properly into their respective nests.

Nests 134, 136 are preferably U-shaped enabling the mandrel to extend into the open end of the U to capture the closed ports. The nests operate to restrain the closed ports from moving backward when they are engaged by the respective mandrels.

Referring now to FIG. 7, there is shown a heat sealed end of a flexible plastic medical container 10' utilizing closed ports 22', 24', which do not have overlying tabs for covering the ends of the ports. Ports 22', 24' comprise rigid plastic tubes having transverse pierceable membranes 36' therein. Connection of ports 22' and 24' to the plastic webs may be made in the same manner as illustrated with respect to closed ports 22, 24 having tabs 38.

Although an illustrative embodiment of the invention has been shown and described, it is to be understood that various modifications and substitutions may be made by those skilled in the art without departing from the novel spirit and scope of the present invention.

That which is claimed is:

1. A method for manufacturing plastic containers having closed ports extending from one end of the plastic containers, which comprises the steps of:

providing a first web of plastic material;

providing a second web of plastic material opposing said first web;

conveying said first and second webs to a port sealing station in a first direction;

conveying a closed port to a position adjacent said port sealing station;

providing a mandrel intermediate said first and second webs at said port sealing station;

moving said mandrel relatively with respect to said closed port in a second direction transverse said first direction to engage said closed port with said mandrel;

retracting said mandrel away from said closed port position in said second direction to bring said closed port toward said webs and then intermediate front opposed ends of said first and second webs;

sealing said front opposed ends of said first and second webs while said closed port is intermediate said front opposed ends;

retracting said mandrel to disengage from said closed port;

sealing the sides and back opposed ends of the webs; and cutting the webs transverse their direction of conveyance.

2. A method as described in claim 1, wherein the steps of providing said first and second webs comprise the providing of a double ply roll of flexible plastic material.

3. A method as described in claim 1, including the steps of cutting to a predetermined shape the ends of the webs in the direction of conveyance upstream of the port sealing station; and splitting the webs apart from each other downstream of said cutting to a predetermined shape but upstream of the port sealing station.

4. A method as described in claim 1, said plastic material comprising a flexible vinyl sheet material and said sealing comprising heat sealing.

5. A method as described in claim 1, said step of moving said mandrel relatively with respect to said closed port comprising moving said mandrel forwardly through both webs so that a front end of the mandrel extends past said front opposed ends of said webs to engage said closed port, with said mandrel being received inside said closed port with sufficient frictional engagement to enable said closed port to move with said mandrel when said mandrel is retracted.

6. A method as described in claim 1, wherein the step of sealing the sides and other end of the webs occurs downstream of said port sealing station.

7. A method as described in claim 6, wherein the step of cutting the webs transverse their direction of conveyance occurs downstream of sealing of the sides and back opposed ends of the webs.

8. A method as described in claim 1, in which a plurality of closed ports are conveyed to said port sealing station and a plurality of mandrels are simultaneously provided, moved and retracted to manufacture a plastic container having a plurality of closed ports extending from one end thereof.

9. A method as described in claim 1, in which a plurality of closed ports are conveyed to said port sealing station and a plurality of mandrels are simultaneously provided, moved and retracted to manufacture simultaneously a plurality of plastic containers, each having a closed port extending from one end thereof.

10. A method as described in claim 1, including the step of providing an elongated tube having an end thereof next to said closed port adjacent said port sealing station; providing another mandrel to operate simultaneously with the closed port mandrel to engage the elongated tubes' end and to bring it toward said webs and then intermediate front opposed ends of said webs, whereby the resulting container will have a closed port and an elongated tube extending from one end thereof.

11. A method as described in claim 10, including the step of providing said elongated tube from a tube roll, with scored portions of the tube located in positions where the tube is to be separated.

12. A method as described in claim 11, including the step of providing tension on said elongated tube after it is sealed to the webs, whereby conveyance of the webs will result in separation of the tube at a scored portion.

13. A method for manufacturing plastic containers having closed ports extending from one end of the plastic containers, which comprises the steps of:

providing a double ply roll of flexible plastic material to thereby provide a first web of plastic material and a second web of plastic material opposing said first web;

conveying said first and second webs to a port sealing station in a first direction;

splitting the webs apart from each other downstream of the port sealing station;

conveying a closed port to a position adjacent said port sealing station;

providing a mandrel intermediate said first and second webs at said port sealing station;

moving said mandrel in a second direction transverse said first direction and forwardly through both webs so that a front end of the mandrel extends past opposed ends of said webs to engage said closed port, with said mandrel being received inside said closed port with sufficient frictional engagement to enable said closed port to move with said mandrel when said mandrel is retracted;

retracting said mandrel away from said closed port position to bring said closed port toward said webs and then intermediate said front opposed ends of said first and second webs;

heat sealing said front opposed ends of said first and second webs while said closed port is intermediate said front opposed ends;

sealing the sides and back opposed ends of the webs; and sealing said front opposed ends of said first and second webs while said closed port and elongated tube is intermediate said front opposed ends;

retracting said mandrels to disengage from said closed port and elongated tube;

sealing the sides and back opposed ends of the webs; and cutting the webs transverse their direction of conveyance.

14. A method as described in claim 13, wherein the step of sealing the sides and back opposed ends of the webs occurs downstream of said port sealing station and wherein the step of cutting the webs transverse their direction of conveyance occurs downstream of sealing of the sides and other end of the webs.

15. A method as described in claim 13, in which a plurality of closed ports are conveyed to said port sealing station and a plurality of mandrels are simultaneously provided, moved and retracted to manufacture a plastic container having a plurality of closed ports extending from one end thereof.

16. A method as described in claim 13, in which a plurality of closed ports are conveyed to said port sealing station and a plurality of mandrels are simultaneously provided, moved and retracted to manufacture simultaneously a plurality of plastic containers, each having a closed port extending from one end thereof.

17. A method for manufacturing a flexible plastic blood container having a closed port and an elongated tube extending from one end of the blood container, which comprises the steps of:

providing a first web of plastic material;

providing a second web of plastic material opposing said first web;

conveying said first and second webs to a port sealing station in a first direction;

conveying a closed port to a position adjacent said port sealing station;

providing an elongated tube having an end thereof next to said closed port adjacent said port sealing station;

providing a pair of mandrels intermediate said first and second webs at said port sealing station;

moving said mandrels simultaneously and relatively with respect to said port and elongated tube in a second direction transverse said first direction to engage said closed port and elongated tube with said mandrels;

retracting said mandrels simultaneously away from said closed port position in said second direction to bring said closed port and said elongated tube toward said webs and then intermediate front opposed ends of said first and second webs;

sealing said front opposed ends of said first and second webs while said closed port and elongated tube is intermediate said front opposed ends;

retracting said mandrels to disengage from said closed port and elongated tube;

sealing the sides and back opposed ends of the webs; and cutting the webs transverse their direction of conveyance.

18. A method as described in claim 17, wherein said elongated tube is provided from a tube roll, with scored portions of the tube located in positions where the tube is to be separated.

19. A method as described in claim 18, including the step of providing tension on said elongated tube after it is sealed to the webs, whereby conveyance of the webs will result in separation of the tube at a scored portion.

20. A method for manufacturing a flexible plastic blood container having an elongated tube extending from one end thereof, which comprises the steps of:

providing a first web of plastic material;

providing a second web of plastic material opposing said first web;

conveying said first and second webs to a tube sealing station in a first direction;

conveying an elongated tube to a position adjacent said tube sealing station;

providing a mandrel intermediate said first and second webs at said tube sealing station;

moving said mandrel relatively with respect to said tube in a second direction transverse said first direction to engage said tube with said mandrel;

retracting said mandrel away from said tube position in said second direction to bring said tube toward said webs and then intermediate front opposed ends of said first and second webs;

sealing said front opposed ends of said first and second webs while said tube is intermediate said front opposed ends;

retracting said mandrel to disengage from said tube;

said elongated tube being provided from a tube roll, with scored portions of the tube located in positions where the tube is to be separated;

providing tension on said elongated tube after it is sealed to the webs, whereby conveyance of the webs will result in separation of the tube at a scored portion;

sealing the sides and back opposed ends of the webs; and cutting the webs transverse their direction of conveyance.

21. Apparatus for manufacturing plastic containers having closed ports extending from one end of the plastic containers, which comprises:

means for conveying in a first direction first and second webs of plastic material to a port sealing station;

a port sealing station including a mandrel and means for moving said mandrel in forward and retracted positions transverse said conveying means;

means for conveying closed ports to a position adjacent said port sealing station;

said web conveying means including means for conveying said first web over said mandrel and means for conveying said second web under said mandrel;

said mandrel moving means being operative to move the mandrel in a second direction transverse said first direction to engage a closed port with the mandrel and to bring the closed port intermediate front opposed ends of the first and second webs;

sealing means at said port sealing station for sealing said front opposed ends while the closed port is intermediate said front opposed ends;

means for conveying the webs with the sealed opposed ends away from the port sealing station;

means for sealing the sides and back opposed ends of the webs; and means for cutting the webs transverse said conveying means.

22. Apparatus as described in claim 21, including means located upstream of the port sealing station for cutting to a predetermined shape the ends of the webs in the direction of said conveyor means.

23. Apparatus as described in claim 22, including means downstream of said predetermined-shape cutting means but upstream of the port sealing station for splitting the webs apart from each other.

24. Apparatus as described in claim 21, said plastic material comprising a flexible vinyl sheet material and said sealing comprising heat sealing.

25. Apparatus as described in claim 21, in which said port sealing station includes a plurality of mandrels and said closed port conveying means are operative to convey a plurality of ports to a position adjacent said port sealing station, said mandrel moving means being operative to move said plurality of mandrels simultaneously to engage a plurality of closed ports with the mandrels, whereby the plastic container is manufactured having a plurality of closed ports extending from said front opposed ends thereof.

26. Apparatus as described in claim 21, in which said port sealing station includes a plurality of mandrels and said closed port conveying means are operative to convey a plurality of ports to a position adjacent said port-sealing station, said mandrel moving means being operative to move said plurality of mandrels simultaneously to engage a plurality of closed ports with the mandrels, whereby a plurality of plastic containers are manufactured simultaneously, each having a closed port extending from said front opposed ends thereof.

27. Apparatus as described in claim 21, including means for providing an elongated tube having an end thereof next to said closed port adjacent said port sealing station; said port sealing station including another mandrel to operate simultaneously with the closed port mandrel to engage the elongated tube's end and to bring it toward said webs and then intermediate front opposed ends of said webs, whereby the resulting container will have a closed port and an elongated tube extending from said front opposed ends thereof.

* * * * *